US008722302B2

(12) United States Patent
Maeda et al.

(10) Patent No.: US 8,722,302 B2
(45) Date of Patent: May 13, 2014

(54) METHOD FOR PRODUCING LIQUID DEVELOPER

(75) Inventors: Hirohito Maeda, Osaka (JP); Katsutoshi Okamoto, Osaka (JP); Takaaki Yodo, Osaka (JP); Naoya Inazumi, Osaka (JP); Koji Iwase, Osaka (JP)

(73) Assignee: Sakata Inx Corp., Osaka (JP)

( * ) Notice: Subject to any disclaimer, the term of this patent is extended or adjusted under 35 U.S.C. 154(b) by 189 days.

(21) Appl. No.: 12/679,822

(22) PCT Filed: Sep. 26, 2008

(86) PCT No.: PCT/JP2008/067520

§ 371 (c)(1), (2), (4) Date: Sep. 1, 2010

(87) PCT Pub. No.: WO2009/041634

PCT Pub. Date: Apr. 2, 2009

(65) Prior Publication Data

US 2010/0323291 A1 Dec. 23, 2010

(30) Foreign Application Priority Data

Sep. 28, 2007 (JP) ..... 2007-254484

(51) Int. Cl.
*G03G 9/13* (2006.01)

(52) U.S. Cl.
USPC ..... 430/114; 430/112; 430/137.22

(58) Field of Classification Search
USPC ..... 430/112, 114, 137.22
See application file for complete search history.

(56) References Cited

U.S. PATENT DOCUMENTS

| | | | | |
|---|---|---|---|---|
| 4,962,150 | A | 10/1990 | Allen | |
| 5,760,257 | A | 6/1998 | Tanaka et al. | |
| 6,395,805 | B1 | 5/2002 | Takao | |
| 6,527,845 | B1 | 3/2003 | Tsuchiya et al. | |
| 2007/0184378 | A1 * | 8/2007 | Miura et al. | 430/114 |
| 2009/0246678 | A1 | 10/2009 | Yodo et al. | |

FOREIGN PATENT DOCUMENTS

| | | | |
|---|---|---|---|
| CN | 1310748 | | 8/2001 |
| EP | 1 898 267 | | 3/2008 |
| EP | 1956438 | A1 * | 8/2008 |
| JP | 1-299632 | | 12/1989 |
| JP | 9-169821 | | 6/1997 |
| JP | 2001-31900 | | 2/2001 |
| JP | 2003-277660 | | 10/2003 |
| JP | 2007-3974 | | 1/2007 |
| JP | 2007-121660 | | 5/2007 |
| JP | 2007-187989 | | 7/2007 |
| WO | WO 2007000974 | A1 * | 1/2007 |
| WO | 2007/061072 | | 5/2007 |

* cited by examiner

*Primary Examiner* — Jonathan Jelsma
(74) *Attorney, Agent, or Firm* — Hamre, Schumann, Mueller & Larson, P.C.

(57) ABSTRACT

The present invention provides a method for producing a liquid developer for electrophotography or electrostatic recording obtained by a coacervation method, which sufficiently maintains the charging property and has good dispersion stability of colored resin particles, as well as a liquid developer obtained by the method.

A method for producing a liquid developer by a coacervation method, wherein a colored resin particle is dispersed in an insulating hydrocarbon dispersion medium in the presence of a particle dispersant and an acid group-containing resin, and the particle dispersant is a reaction product of a polyamine compound and a self-condensation product of a hydroxycarboxylic acid.

12 Claims, No Drawings

METHOD FOR PRODUCING LIQUID DEVELOPER

TECHNICAL FIELD

The present invention relates to a method for producing a liquid developer for electrophotography or electrostatic recording to be employed for printing apparatus, copying machines, printers, facsimiles, and a liquid developer obtained by the production method.

BACKGROUND ART

For a liquid developer, in general, those with a form that colored resin particles containing coloring agents such as pigments are dispersed in an electrically insulating dispersion medium are used. As one of methods for producing the liquid developer, there is a coacervation method. The coacervation method is a method of precipitating a resin contained in a mixed solution in a dissolved state in a manner of encapsulating a coloring agent by removing a solvent from the mixed solution containing the solvent dissolving the resin and an electrically insulating dispersion medium which does not dissolve the resin; and dispersing the colored resin particles in the electrically insulating dispersion medium.

A liquid developer obtained by the method is supposed to have a good electrophoretic property since the colored resin particles have shapes closer to spheres and more uniform particle sizes than those obtained by a wet-milling method.

However, the coacervation method has a problem that the colored resin particles are easily agglomerated at the time of precipitation of the resin and due to the coarsening of the particles, the dispersion stability and optical characteristics of the obtained developer are insufficient.

Therefore, to solve the above-mentioned problem, there is proposed a method using a polymer compound having an acid group and a polymer compound having a basic group in the coacervation method. In this method, first, either one of the polymer compounds is adsorbed on the coloring agent surface. Next, the coloring agent is encapsulated in the other polymer compound, so that the colored resin particles are stably dispersed in an electrically insulating dispersion medium (e.g., refer to Patent Document 1).

However, the above-mentioned method is a technique based on the concept of the conventionally well known acid-base interaction which aims to achieve dispersion stability by treating the pigment surface with a compound containing an acid group or a basic group and increasing the affinity to the resin having the other group. Further, the disclosed compounds are fairly commonly used acrylic resins and styrene-acrylic resins. Since these compounds are not materials that are designed focusing on the dispersibility of particles, an effect of sufficiently improving the dispersibility of fine colored resin particles cannot be expected. Moreover, in terms of the suitability for a liquid developer, there is another problem that the charging property and the electrophoretic property of the colored resin particles are deteriorated and thus it results in impossibility of obtaining a good image quality.

Patent Document 1: Japanese Kokai Publication 2001-31900

DISCLOSURE OF THE INVENTION

Problems to be Solved by the Invention

Therefore, in a liquid developer for electrophotography and electrostatic recording to be obtained by a coacervation method, the present invention aims to provide a method for producing a liquid developer which sufficiently maintains the charging property as a liquid developer and has good dispersion stability of colored resin particles as well as a liquid developer obtained by the method.

Means for Solving the Problems

The inventors of the present invention made various investigations to solve the above-mentioned problems and have found that the dispersion stability of colored resin particles can be remarkably improved and the charging property of a liquid developer can be improved by using the following specific dispersant for dispersing the colored resin particles and also using an acid group-containing resin, and this finding has now led to completion of the present invention.

That is, the present invention relates to (1) a method for producing a liquid developer by a coacervation method, wherein a colored resin particle is dispersed in an insulating hydrocarbon dispersion medium in the presence of a particle dispersant and an acid group-containing resin, and the particle dispersant is a reaction product of a polyamine compound and a self-condensation product of a hydroxycarboxylic acid.

The present invention also relates to (2) the method for producing a liquid developer according to (1), wherein the particle dispersant is a reaction product of a polyamine compound and a self-condensation product of 12-hydroxystearic acid.

The present invention also relates to (3) the method for producing a liquid developer according to (1) or (2), wherein the particle dispersant is a reaction product of a polyallylamine and a self-condensation product of 12-hydroxystearic acid.

The present invention also relates to (4) the method for producing a liquid developer according to any one of (1) to (3), wherein the amine value of the particle dispersant is 5 to 300 mgKOH/g.

The present invention also relates to (5) the method for producing a liquid developer according to any one of (1) to (4), wherein the acid group-containing resin is a carboxyl group-containing resin.

The present invention also relates to (6) the method for producing a liquid developer according to any one of (1) to (5), wherein the acid value of the acid group-containing resin is 1 to 250 mgKOH/g.

The present invention also relates to (7) the method for producing a liquid developer according to any one of (1) to (6), wherein a paraffin compound with a boiling point of 150° C. or higher is used as the insulating hydrocarbon dispersion medium.

The present invention also relates to (8) a liquid developer produced by the method for producing a liquid developer according to any one of (1) to (7).

Hereinafter, a method for producing a liquid developer of the present invention and a liquid developer obtained by the method will be described in detail.

First, materials to be used in the liquid developer of the present invention will be described.

As pigments to be used for the liquid developer of the present invention, inorganic pigments and organic pigments are usable.

Preferable examples of the inorganic pigments include acetylene black, graphite, red ion oxide, chrome yellow, ultramarine blue, and carbon black.

Preferable examples of the organic pigments include azo pigments, lake pigments, phthalocyanine pigments, isoindoline pigments, anthraquinone pigments, and quinacridone pigments.

In the present invention, the content of these pigments is not particularly limited, but in terms of the image density, it is preferable that 2 to 20% by weight of these pigments are contained in the final liquid developer.

Next, as a pigment dispersant for dispersing the above-mentioned pigments to be used in the liquid developer of the present invention, conventionally known pigment dispersants can be used. Specific examples thereof include surfactants such as anionic surfactants, nonionic surfactants, cationic surfactants, amphoteric surfactants, silicon surfactants, and fluorine surfactants, and derivatives thereof; polyurethane resins; (poly)amine derivatives obtained by introducing polyesters into amino groups and/or imino groups of (poly)amine compounds; polymeric pigment-dispersing resins such as carbodiimide compounds having polyester side chains, polyether side chains, or polyacrylic side chains (International Publication WO03/076527), carbodiimide compounds having basic nitrogen-containing groups and also, as side chains, polyester side chains, polyether side chains, or polyacrylic side chains (International Publication WO04/000950), and carbodiimide compounds having side chains containing pigment adsorption parts (International Publication WO04/003085). Those commercially available include BYK-160, 162, 164, 182 (manufactured by BYK Japan KK), EFKA-47 (manufactured by EFKA), Ajisper-PB-821 (manufactured by Ajinomoto Fine-Techno Co., Inc.), and Solsperse 24000 (manufactured by Lubrizol Japan Ltd.).

Next, as a binder resin to be used for the liquid developer of the present invention, conventionally known binder resins having a fixation property for an object to be bonded such as paper or plastic films can be used. Examples to be used include resins such as epoxy resins, ester resins, acrylic resins, alkyd resins, and rosin-modified resins. Further, if necessary, these resins may be used alone or two or more of them may be used in combination.

As an insulating hydrocarbon dispersion medium which does not dissolve an acid group-containing resin described later and used in the liquid developer of the present invention, preferable are those which do not dissolve an acid group-containing resin described later, have an electrically insulating property and are not volatilized at the time of organic solvent removal. Examples of the dispersion medium satisfying such conditions include non-volatile or slightly volatile insulating hydrocarbon compounds. Aliphatic hydrocarbons and alicyclic hydrocarbons are more preferable. Moreover, as long as not dissolving an acid group-containing resin described later, aromatic hydrocarbons and halogenated hydrocarbons are also usable. Specially, in terms of odor, harmlessness, and cost, high boiling point (having a boiling point of 150° C. or higher) paraffin solvents such as normal paraffin compounds, iso-paraffin compounds, cycloparaffin compounds and mixtures of two or more of these compounds are preferable. Concretely, those commercially available include Isopar G, Isopar H, Isopar L, Isopar M, Exxsol D130, and Exxsol D140 (all manufactured by Exxon Chemical), Shellsol 71 (manufactured by Showa Shell Sekiyu K.K.), IP Solvent 1620, IP Solvent 2028, and IP Solvent 2835 (all manufactured by Idemitsu Petrochemical Co., Ltd.), Moresco White P-40, Moresco White P-55, and Moresco White P-80 (all liquid paraffins manufactured by Matsumura Oil Research Corp.), Liquid Paraffin No. 40-S and Liquid Paraffin No. 55-S (all liquid paraffins manufactured by Chuo Kasei Co., Ltd.).

Next, the particle dispersant to be used for dispersing the colored resin particles in the insulating hydrocarbon dispersion medium to be used in the liquid developer of the present invention is a reaction product of a polyamine compound and a self-condensation product of a hydroxycarboxylic acid. At the time of production of a liquid developer by a coacervation method, it is made possible to improve the dispersion stability of colored resin particles in an insulating hydrocarbon dispersion medium by dispersing the colored resin particles in the insulating hydrocarbon dispersion medium in the presence of the specific particle dispersant and an acid group-containing resin described later in combination. Further, the charging property and the electrophoretic property of the colored resin particles can also be improved.

The polyamine compound is not particularly limited but examples of the polyamine compound include a polyvinylamine polymer, a polyallylamine polymer, a polydiallylamine polymer, or a diallylamine-maleic acid copolymer. Polymers containing a polyaniline unit or a polypyrrole unit are also included. Further, the examples of the polyamine compound include an aliphatic polyamine such as ethylenediamine, an alicyclic polyamine such as cyclopentanediamine, an aromatic polyamine such as phenylenediamine, an araliphatic polyamine such as xylylenediamine, hydrazine or a derivative thereof. Among them, polyallylamine polymers such as a polyallylamine are preferable.

The hydroxycarboxylic acid composing the self-condensation product of a hydroxycarboxylic acid is not particularly limited but the examples of the hydroxycarboxylic acid include glycolic acid, lactic acid, oxy-butyric acid, hydroxyvaleric acid, hydroxycaproic acid, hydroxycaprylic acid, hydroxycapric acid, hydroxylauric acid, hydroxymyristic acid, hydroxypalmitic acid, hydroxystearic acid, ricinoleic acid, castor oil fatty acid, and hydrogenated products thereof. Preferable examples include hydroxycarboxylic acids having 12 to 20 carbon atoms, more preferable examples include 12-hydroxycarboxylic acids having 12 to 20 carbon atoms, and particularly preferable examples include 12-hydroxystearic acid.

Examples of a preferable particle dispersant include a reaction product of a polyamine compound and a self-condensation product of a hydroxystearic acid. Concrete examples thereof include reaction products of polyamine compounds and self-condensation products of 12-hydroxystearic acid, such as reaction products of polyallylamines and self-condensation products of 12-hydroxystearic acid, reaction products of polyethylenepolyamines and self-condensation products of 12-hydroxystearic acid, reaction products of dialkylaminoalkylamines and self-condensation products of 12-hydroxystearic acid, reaction products of polyvinylamines and self-condensation products of 12-hydroxystearic acid. Those commercially available include Ajisper-PB817 (manufactured by Ajinomoto Co., Inc.), Solsperse 11200, 13940, 17000, and 18000 (manufactured by Lubrizol Japan Ltd.). Particularly preferable among them are reaction products of polyallylamines and self-condensation products of 12-hydroxystearic acid, since they are excellent in the particle dispersibility in the initial period and during the long time preservation and also excellent in charging property.

In the present invention, these particle dispersants may be used alone or in combination of two or more species. The amount of the particle dispersant contained in the liquid developer is preferably 0.5 to 3.0% by weight.

The amine value of the particle dispersant is preferably 5 to 300 mgKOH/g. If the amine value is within the above-mentioned range, it is possible to obtain good dispersion stability of the colored resin particles and also an excellent charging property.

In this specification, the amine value means an amine value per 1 g of solid matter and is a value measured by carrying out potentiometric titration (e.g. COMTITE (AUTO TITRATOR COM-900, BURET B-900, TITSTATIONK-900), manufactured by Hiranuma Sangyo Corp.) using an aqueous 0.1 N hydrochloric acid solution and thereafter converting the resulting value into potassium hydroxide equivalent.

Concrete examples of the acid group-containing resin to be used in the liquid developer of the present invention include those obtained by modifying polyolefin resins and introducing carboxyl groups therein, and those obtained by introducing carboxyl groups by a method using carboxylic acid compounds as polymerization materials or additional materials, or by a peroxide treatment, into olefin resins such as ethylene-(meth)acrylic acid copolymers, ethylene-vinyl acetate copolymers, partially saponified ethylene-vinyl acetate copolymers, ethylene-(meth)acrylic acid ester copolymers, polyethylene resins, and polypropylene resins; thermoplastic saturated polyester resins, styrene resins such as styrene-acrylic copolymer resins, and styrene-acryl-modified polyester resins; alkyd resins, phenol resins, epoxy resins, rosin-modified phenol resins, rosin-modified maleic resins, rosin-modified fumaric acid resins, acrylic resins such as (meth) acrylic acid ester resins, vinyl chloride resins, vinyl acetate resins, vinylidene chloride resins, fluororesins, polyamide resins, polyacetal resins, and polyester resins. Particularly preferable among them are carboxyl group-containing styrene-acrylic copolymer resins and polyester resins since use of them results in good effects of the present invention.

The carboxyl group-containing styrene-acrylic copolymer resins are resins obtained by copolymerization of monomer compositions each containing a styrene monomer and an acrylic monomer and have carboxyl groups in the molecule.

Examples of the styrene monomer include styrene and styrene derivatives such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene. The carboxyl group-containing styrene-acrylic copolymer resins are preferably those obtained by using styrene as the styrene monomers.

Examples of the carboxyl group-containing monomer as the acrylic monomer include α,β-unsaturated acids such as acrylic acid, methacrylic acid, crotonic acid, and cinnamic acid; unsaturated dibasic acids such as maleic acid, citraconic acid, itaconic acid, alkenylsuccinic acid, fumaric acid, and mesaconic acid; half esters of unsaturated dibasic acids such as maleic acid methyl half ester, maleic acid ethyl half ester, fumaric acid methyl half ester, and mesaconic acid methyl half ester. The carboxyl group-containing styrene-acrylic copolymer resins are preferably those obtained by using acrylic acid or methacrylic acid as the carboxyl group-containing acrylic monomer.

Other examples of the acrylic monomer include (meth) acrylic acid esters such as methyl (meth)acrylate, ethyl (meth)acrylate, propyl (meth)acrylate, n-butyl (meth)acrylate, isobutyl (meth)acrylate, n-octyl (meth)acrylate, dodecyl (meth)acrylate, 2-ethylhexyl (meth)acrylate, stearyl (meth) acrylate, phenyl (meth)acrylate, dimethylaminoethyl (meth) acrylate, and diethylaminoethyl (meth)acrylate.

Synthesis of the carboxyl group-containing styrene-acrylic copolymer resins is carried out by a conventionally known method. For example, a method of adding a polymerization catalyst to a mixed solution obtained by dissolving the various kinds of monomers in a solvent and carrying out polymerization at a prescribed temperature can be exemplified.

Further, specific examples of the polyester resins as the acid group-containing resins include M403 (acid value 19, manufactured by Sanyo Chemical Industries, Ltd.) and Diacron FC1565 (acid value 4, manufactured by Mitsubishi Rayon Co., Ltd.).

In the present invention, one or more of these acid group-containing resins can be employed. The content of the acid group-containing resin(s) is preferably 1.0 to 15.0% by weight.

The acid value of the acid group-containing resin is preferably 1 to 250 mgKOH/g. When the acid value is within the above-mentioned range, it is possible to obtain good dispersion stability of the colored resin particles and also an excellent charging property.

In this specification, the acid value means an acid value per 1 g of solid matter and is a value measured by potentiometric titration (e.g. COMTITE (AUTO TITRATOR COM-900, BURET B-900, TITSTATION K-900), manufactured by Hiranuma Sangyo Corp.) according to JIS K 0070.

The weight average molecular weight of the acid group-containing resin is preferably 30000 to 100000 and more preferably 45000 to 75000.

In this specification, the weight average molecular weight is measured by gel permeation chromatography (a GPC method)<polystyrene conversion> using Water 2690 (manufactured by Waters) as an apparatus and PLgel 5μ MIXED-D (manufactured by Polymer Laboratories) as a column.

The liquid developer of the present invention may further contain a charge control agent if necessary, besides these materials. As the charge control agent, there are broadly the following two types, (1) and (2).

(1) A type obtained by coating surfaces of toner particles with a substance capable of ionization or adsorbing ions. Preferable examples of this type include fats and oils such as linseed oil and soybean oil; alkyd resins, halogenated polymers, aromatic polycarboxylic acids, acid group-containing water-soluble dyes, and oxidation condensation products of aromatic polyamines.

(2) A type which can be dissolved in an insulating hydrocarbon dispersion medium and allows coexistence of a substance capable of receiving and sending ions from and to toner particles. Preferable examples of this type include metal soaps such as cobalt naphthate, nickel naphthate, iron naphthate, zinc naphthate, cobalt ocylate, nickel ocylate, zinc ocylate, cobalt dodecylate, nickel dodecylate, zinc dodecylate, and cobalt 2-ethylhexanoate; sulfonic acid metal salts such as petroleum sulfonic acid metal salts and sulfosuccinic acid ester metal salts; phospholipids such as lecithin; salicylic acid metal salts such as tert-butylsalicylic acid metal complexes; polyvinylpyrrolidone resins, polyamide resins, sulfonic acid-containing resins, and hydroxybenzoic acid derivatives. In addition, other additives may also be added if necessary.

Next, a method for producing the liquid developer of the present invention will be described.

The liquid developer of the present invention is produced by a coacervation method.

The "coacervation method" is a method for forming colored resin particles by encapsulating a coloring agent (pigment) in a resin during shifting the resin from a dissolved state to a precipitated state by changing the mixing ratio between a good solvent and a poor solvent in a mixed solution of the resin in the solvents.

In the present invention, a method employed involves: dispersing a pigment; adding a particle dispersant; removing an organic solvent from a mixed solution of the organic solvent which can dissolve the acid group-containing resin and an insulating hydrocarbon dispersion medium which cannot dissolve the acid group-containing resin; precipitating the colored resin particles in a manner that the resin encapsulates the pigment; and dispersing the particles in the insulating hydrocarbon dispersion medium.

The binder resin to be used in this method is preferably a thermoplastic resin having a fixation property to an adherend such as paper or a plastic film. Concrete examples of the binder resin include those obtained by modifying polyolefin resins and introducing carboxyl groups therein, olefin resins such as ethylene-(meth)acrylic acid copolymers, ethylene-vinyl acetate copolymers, partially saponified ethylene-vinyl acetate copolymers, ethylene-(meth)acrylic acid ester copolymers, polyethylene resins, and polypropylene resins; thermoplastic saturated polyester resins; styrene resins such as styrene-acrylic copolymer resins, and styrene-acryl-modified polyester resins; alkyd resins, phenol resins, epoxy resins, polyester resins, rosin-modified phenol resins, rosin-modified maleic resins, rosin-modified fumaric acid resins, acrylic resins such as (meth)acrylic acid ester resins, vinyl chloride resins, vinyl acetate resins, vinylidene chloride resins, fluororesins, polyamide resins, and polyacetal resins. These resins may be used alone or in combination of two or more species.

The organic solvent to be used in this method may be an organic solvent which dissolves the acid group-containing resin and is preferably a low boiling point solvent because of easiness of removal from the mixed solution by distillation. Examples thereof include ethers such as tetrahydrofuran; ketones such as methyl ethyl ketone and cyclohexanone; and esters such as ethyl acetate. Further, aromatic hydrocarbons such as toluene and benzene can also be used if they are capable of dissolving resins. These solvents may be used alone or in combination of two or more species.

In a specific production method, first, a pigment, a pigment dispersant, and a portion of an organic solvent are mixed and a pigment dispersion is prepared by dispersing the pigment by a media type dispersing apparatus such as an attriter, a ball mill, a sand mill, or a bead mill or a non-media type dispersing apparatus such as a high speed mixer or a high speed homogenizer. Next, a binder resin, an acid group-containing resin, and the remaining organic solvent are added to the pigment dispersion. Thereafter, a particle dispersant is further added and while the mixture is stirred by a high speed shear stirring apparatus, an insulating hydrocarbon dispersion medium is added to the mixture to obtain a mixed solution. At the time of preparing the pigment dispersion, the resins (the binder resin and the acid group-containing resin) may be added previously and thereafter the pigment may be dispersed.

Next, while the mixed solution being stirred by a high speed shear stirring apparatus, the organic solvent is removed by distillation to obtain the liquid developer of the present invention. If the solid matter concentration in the obtained liquid developer is high, the insulating hydrocarbon dispersion medium may be added so as to achieve a desired solid matter concentration. Moreover, a charge control agent and other additives may be added if necessary. In addition, removal of the organic solvent by distillation and addition of the insulating hydrocarbon dispersion medium may be carried out simultaneously to obtain the liquid developer of the present invention.

As the high speed shear stirring apparatus, a homogenizer and a homo-mixer which can apply stirring and shearing force, can be employed. There are various types of apparatus varying in capacity, rotation speed, model, etc., but any proper apparatus may be employed in accordance with the production manner. In the case of using a homogenizer, the rotation speed is preferably 500 rpm or higher.

Effects of the Invention

The method for producing a liquid developer of the present invention employing a coacervation method provides a liquid developer significantly excellent in the dispersion stability of colored resin particles by using a specific particle dispersant and acid group-containing resin. Further, due to an excellent charging property and an electrophoretic property of the colored resin particles, a good image quality can be obtained.

BEST MODE FOR CARRYING OUT THE INVENTION

Hereinafter, the present invention will be described in more detail by way of examples, but the present invention is not limited to these examples. In addition, "part(s)" and "%" refer to "part(s) by weight" and "% by weight" in Examples, unless otherwise specified.

Respective materials used in the following examples and comparative examples will be described.

<Pigment>

MA 285 (carbon black, manufactured by Mitsubishi Chemical Corp.)

<Pigment Dispersant>

A four-neck flask equipped with a reflux condenser, a nitrogen gas introduction tube, a stirring rod, and a thermometer was loaded with 132.6 parts of a toluene solution (solid content 50%) of a polycarbodiimide compound having isocyanate groups and having a carbodiimide equivalent of 316 and 12.8 parts of N-methyldiethanolamine and kept at about 100° C. for 3 hours to carry out a reaction of isocyanate groups and hydroxyl groups. Next, 169.3 parts of a ring-opened product of polycaprolactone having carboxyl groups at terminals and having a number average molecular weight of 2000 was added and kept at about 80° C. for 2 hours to carry out a reaction of the carbodiimide groups and carboxyl groups. Finally, toluene was removed by distillation under reduced pressure to obtain a pigment dispersion (solid content 100%).

<Binder Resin 1>

YD-011 (epoxy resin/manufactured by Tohto Kasei Co., Ltd.)

<Binder Resin 2>

Vylon 220 (polyester resin/manufactured by Toyobo Co., Ltd.)

<Particle Dispersant 1>

Ajisper-PB817 (a reaction product of a polyallylamine and a self-condensation product of 12-hydroxystearic acid/amine value 15/manufactured by Ajinomoto Co., Inc.)

<Particle Dispersant 2>

Solsperse 11200 (a reaction product of a polyethylenepolyamine and a self-condensation product of 12-hydroxystearic acid/amine value 74/manufactured by Lubrizol Japan Ltd.)

<Particle Dispersant 3>

Solsperse 13940 (a reaction product of a polyethylenepolyamine and a self-condensation product of 12-hydroxystearic acid/amine value 250/manufactured by Lubrizol Japan Ltd.)

<Particle Dispersant 4>

Ajisper-PB821 (a reaction product of a polyallylamine and polycaprolactone/amine value 8/manufactured by Ajinomoto Co., Inc.)

<Acid Group-Containing Resins 1 to 7>

Acid group-containing resins 1 to 5 were obtained by a polymerization reaction of monomers with the compositions (mole ratios) as shown in Table 1. As an acid group-containing resin 6, a polyester resin (M403, acid value 19, manufactured by Sanyo Chemical Industries, Ltd.) was used. As an acid group-containing resin 7, a polyester resin (Diacron FC1565, acid value 4, manufactured by Mitsubishi Rayon Co., Ltd.) was used.

TABLE 1

| Resin No./monomer | St | SMA | BA | AA | Mw | Av |
|---|---|---|---|---|---|---|
| Acid group-containing resin 1 | 85 | 5 | — | 10 | 69900 | 50 |
| Acid group-containing resin 2 | 80 | 5 | — | 15 | 50000 | 75 |
| Acid group-containing resin 3 | 75 | 5 | — | 20 | 67600 | 100 |
| Acid group-containing resin 4 | 65 | 5 | — | 30 | 71600 | 150 |
| Acid group-containing resin 5 | 77 | — | 9.5 | 13.5 | 50400 | 200 |

Symbols in Table 1 denote as follows:
St: styrene,
SMA: stearyl methacrylate,
BA: butyl acrylate,
AA: acrylic acid,
Mw: weight average molecular weight, and
Av: acid value.

Example 1

After 20.0 parts of MA 285, 8.0 parts of the pigment dispersant, and 72.0 parts of THF were mixed and milled for 15 minutes by a paint shaker using steel beads with a diameter of 5 mm, the mixture was further milled for 2 hours by Eiger Motor Mill M-250 (manufactured by Eiger Japan) using zirconia beads with a diameter of 0.05 mm. Further, 21 parts of the binder resin 1, 3.5 parts of the acid group-containing resin 1, and 58 parts of THF were added to 17.5 parts of the milled mixture and the mixture was heated and stirred at 50° C. Thereafter, 1.0 part of the particle dispersant 1 was added and stirred and then, while being diluted with 69.6 parts of Moresco White P-40 (manufactured by Matsumura Oil Research Corp.), the mixture was stirred to obtain a mixed solution. Next, an apparatus including a homogenizer having a closed stirring vessel connected with a solvent removal apparatus (connected to a depressurizing apparatus) was used to depressurize the mixed solution to adjust the mixed solution temperature at 50° C. while stirring the mixed solution at a high speed (rotation speed of 5000 rpm) by the homogenizer and thus THF was completely removed from the closed stirring vessel to obtain a liquid developer of Example 1.

Example 2

A liquid developer of Example 2 was obtained by a method similar to that of Example 1, except that the particle dispersant 1 was changed to the particle dispersant 2.

Example 3

A liquid developer of Example 3 was obtained by a method similar to that of Example 1, except that the particle dispersant 1 was changed to the particle dispersant 3.

Example 4

A liquid developer of Example 4 was obtained by a method similar to that of Example 1, except that the acid group-containing resin 1 was changed to the acid group-containing resin 2.

Example 5

A liquid developer of Example 5 was obtained by a method similar to that of Example 1, except that the acid group-containing resin 1 was changed to the acid group-containing resin 3.

Example 6

A liquid developer of Example 6 was obtained by a method similar to that of Example 1, except that the acid group-containing resin 1 was changed to the acid group-containing resin 4.

Example 7

A liquid developer of Example 7 was obtained by a method similar to that of Example 1, except that the acid group-containing resin 1 was changed to the acid group-containing resin 5.

Example 8

A liquid developer of Example 8 was obtained by a method similar to that of Example 1, except that TFH was changed to MEK.

Example 9

A liquid developer of Example 9 was obtained by a method similar to that of Example 1, except that TFH was changed to MEK and the binder resin 1 was changed to the binder resin 2.

Example 10

A liquid developer of Example 10 was obtained by a method similar to that of Example 9, except that the acid group-containing resin 1 was changed to the acid group-containing resin 6.

Example 11

A liquid developer of Example 11 was obtained by a method similar to that of Example 9, except that the acid group-containing resin 1 was changed to the acid group-containing resin 7.

Comparative Example 1

A liquid developer of Comparative Example 1 was obtained by a method similar to that of Example 1, except that the particle dispersant 1 was changed to the particle dispersant 4.

Comparative Example 2

A liquid developer of Comparative Example 2 was obtained by a method similar to that of Example 1, except that the acid group-containing resin 1 and the particle dispersant 1 were not added.

Comparative Example 3

A liquid developer of Comparative Example 3 was obtained by a method similar to that of Example 1, except that the particle dispersant 1 was not added.

Comparative Example 4

A liquid developer of Comparative Example 4 was obtained by a method similar to that of Example 1, except that the acid group-containing resin 1 was not added.

<Capability Evaluation>

The respective liquid developers were evaluated by the following evaluation methods. The results are shown in Table 2

(Charging Property and Electrophoretic Property)

Particles were observed by using an electrophoretic cell (conditions: distance between electrodes: 80 μm, applied voltage: 200 V).

(1) Electrophoretic Property good: Particles were smoothly electrophoresed without being agglomerated.

poor: Particles were electrophoresed while forming agglomerates.

bad: Particles were agglomerated between the electrodes and did not move.

(2) Charging Property

When a voltage was applied to the electrophoretic cell,

+: 90% or more of toner particles were electrophoresed to the − electrode side.

−: 90% or more of toner particles were electrophoresed to the + electrode side.

±: other than "+" and "−".

(Particle Size)

Using an optical microscope BH-2 (manufactured by Olympus Corporation), the particle size (the average particle diameter of colored resin particles) was measured by eye observation.

TABLE 2

| | Examples | | | | | | | | | | |
|---|---|---|---|---|---|---|---|---|---|---|---|
| | 1 | 2 | 3 | 4 | 5 | 6 | 7 | 8 | 9 | 10 | 11 |
| Coacervation method (organic solvent) | THF | THF | THF | THF | THF | THF | THF | MEK | MEK | MEK | MEK |
| Binder resin | 1 | 1 | 1 | 1 | 1 | 1 | 1 | 1 | 2 | 2 | 2 |
| Particle dispersant (type) | 1 | 2 | 3 | 1 | 1 | 1 | 1 | 1 | 1 | 1 | 1 |
| Acid group-containing resin (type) | 1 | 1 | 1 | 2 | 3 | 4 | 5 | 1 | 1 | 6 | 7 |
| Electrophoretic property | good | good | good | good | good | good | good | good | good | good | good |
| Charging property | + | + | + | + | + | + | + | + | + | + | + |
| Particle size(μm) | 0.7 | 0.7 | 0.7 | 0.7 | 0.7 | 0.7 | 0.7 | 0.7 | 0.7 | 0.7 | 0.7 |

| | Comparative Examples | | | |
|---|---|---|---|---|
| | 1 | 2 | 3 | 4 |
| Particle dispersant (type) | 4 | — | — | 1 |
| Acid group-containing resin (type) | 1 | — | 1 | — |
| Electrophoretic property | bad | * | poor | * |
| Charging property | ± | * | + | * |
| Particle size(μm) | 1.0< | * | 1.0< | * |

* Since no liquid developer was obtained, evaluation was impossible.

As shown in Table 2, the liquid developers of examples obtained by using the particle dispersants which were reaction products of the polyamine compounds and self-condensation products of hydroxycarboxylic acids and the acid group-containing resins in the coacervation method were found excellent in the electrophoretic property and charging property. The liquid developers were also excellent in the dispersion stability of the colored resin particles. On the other hand, the liquid developers obtained by using the particle dispersant other than the reaction products of the polyamine compounds and self-condensation products of hydroxycarboxylic acids (Comparative Example 1) or by using no acid group-containing resin or no particle dispersant (Comparative Examples 2 to 4) were inferior in the capabilities.

INDUSTRIAL APPLICABILITY

A liquid developer obtained by the production method of the present invention is suitably used for a liquid developer for electrophotography or electrostatic recording to be employed for printing apparatus, copying machines, printers, and facsimiles.

The invention claimed is:

1. A method for producing a liquid developer by a coacervation method comprising steps of:

preparing a mixed solution by mixing a pigment, a pigment dispersant so as to disperse the pigment in the mixed solution, an acid group-containing resin, a binder resin, an organic solvent, a particle dispersant, and an insulating hydrocarbon dispersion medium, wherein the step of preparing the mixed solution comprises:

a step of preparing a pigment dispersion by mixing the pigment, the pigment dispersant, and a portion of the organic solvent, a step of preparing a pre-mixed solution by adding the binder resin, the acid group-containing resin, and a remaining portion of the organic solvent, to the pigment dispersion, and a step of obtaining the mixed solution by adding the particle dispersant to the pre-mixed solution and stirring a mixture of the particle dispersant and the pre-mixed solution, wherein the insulating hydrocarbon dispersion medium is present in the mixture; and removing the organic solvent from the mixed solution, so that colored resin particles precipitate and the particle dispersant disperses the colored resin particles in the insulating hydrocarbon dispersion medium, wherein the colored resin particle is a particle encapsulating the pigment in the acid group-containing resin, and the particle dispersant is a reaction product of a polyamine compound and a self-condensation product of a hydroxycarboxylic acid.

2. The method for producing a liquid developer according to claim 1, wherein the particle dispersant is a reaction product of a polyamine compound and a self-condensation product of 12-hydroxystearic acid.

3. The method for producing a liquid developer according to claim 1, wherein the particle dispersant is a reaction product of a polyallylamine and a self-condensation product of 12-hydroxystearic acid.

4. The method for producing a liquid developer according to claim 1, wherein an amine value of the particle dispersant is from 5 to 300 mgKOH/g.

5. The method for producing a liquid developer according to claim 1, wherein the acid group-containing resin is a carboxyl group-containing resin.

6. The method for producing a liquid developer according to claim 1, wherein an acid value of the acid group-containing resin is from 1 to 250 mgKOH/g.

7. The method for producing a liquid developer according to claim 1, wherein the insulating hydrocarbon dispersion medium is a paraffin compound having a boiling point of 150° C. or higher.

8. A liquid developer produced by the method for producing a liquid developer according to claim 1.

9. The method for producing a liquid developer according to claim 1, wherein the mixed solution consists essentially of the pigment, the pigment dispersant, the acid group-containing resin, the binder resin, the organic solvent, the particle dispersant, and the insulating hydrocarbon dispersion medium.

10. The method for producing a liquid developer according to claim 1, wherein the coacervation method consists essentially of the preparing step and the removing step.

11. The method for producing a liquid developer according to claim 1, wherein the acid group-containing resin is a styrene-acrylic copolymer resin, and the binder resin is a polyester resin or an epoxy resin.

12. The method for producing a liquid developer according to claim 11, wherein an acid value of the acid group-containing resin is 50 to 200 mgKOH/g.

* * * * *